US009924798B2

(12) United States Patent
Broerman et al.

(10) Patent No.: US 9,924,798 B2
(45) Date of Patent: Mar. 27, 2018

(54) THERAPEUTIC CORE BUILDING AND MASSAGE CHAIR

(71) Applicant: Continuum Innovation LLC, West Newton, MA (US)

(72) Inventors: Alex Broerman, Cambridge, MA (US); Doug Kroncke, Wayland, MA (US); Kyle Moise, Boston, MA (US); Gianfranco Zaccai, Needham, MA (US)

(73) Assignee: Continuum Innovation LLC, West Newton, MA (US)

( * ) Notice: Subject to any disclaimer, the term of this patent is extended or adjusted under 35 U.S.C. 154(b) by 323 days.

(21) Appl. No.: 14/699,985

(22) Filed: Apr. 29, 2015

(65) Prior Publication Data

US 2015/0305961 A1 Oct. 29, 2015

Related U.S. Application Data

(60) Provisional application No. 61/986,044, filed on Apr. 29, 2014.

(51) Int. Cl.
*A61H 15/00* (2006.01)
*A47C 3/18* (2006.01)
(Continued)

(52) U.S. Cl.
CPC ..... *A47C 3/18* (2013.01); *A47C 7/004* (2013.01); *A47C 7/006* (2013.01); *A47C 7/022* (2013.01);
(Continued)

(58) Field of Classification Search
CPC ..... A61H 1/008; A61H 1/005; A61H 7/007; A61H 2007/009; A61H 15/00–15/02;
(Continued)

(56) References Cited

U.S. PATENT DOCUMENTS 1,210,223 A * 12/1916 Silbert ..... A47C 7/40 297/452.31
2,219,624 A * 10/1940 Dixon ..... A61H 15/00 297/271.6
(Continued)

FOREIGN PATENT DOCUMENTS

CN 203088261 7/2013
DE 19711924 9/1998

OTHER PUBLICATIONS

International Search Report for International Application PCT/US2015/028355, dated Aug. 7, 2015.

*Primary Examiner* — Valerie L Woodward
(74) *Attorney, Agent, or Firm* — Sean D. Detweiler, Esq.; Morse, Barnes-Brown & Pendleton, P.C.

(57) ABSTRACT

A chair strengthens core muscle groups and promotes circulation along the gluteal and piriformis muscle groups. Locking castors enable the chair to be moved in busy environments, yet fix the position of the chair when needed. A user of the chair may activate a number of massaging elements by rocking side to side, and may perform back stretches while in the seated position. Additional active massaging elements may alert the user and further promote proper use. Adjustable elements allow users to tailor the chair to their specific needs. Embedded energy harvesters supply power to record and transmit data to users to enhance their awareness of their seating position. Thus a versatile seat is provided that is better suited to active environments while broadening the range of elements of core strengthening, massaging, circulation, and seated exercise.

9 Claims, 4 Drawing Sheets

(51) Int. Cl.

| | |
|---|---|
| ***A47C 7/02*** | (2006.01) |
| ***A47C 7/40*** | (2006.01) |
| ***A61H 23/02*** | (2006.01) |
| ***A47C 9/00*** | (2006.01) |
| ***A47C 7/00*** | (2006.01) |

(52) U.S. Cl.
CPC ..... *A47C 7/402* (2013.01); *A47C 9/002* (2013.01); *A61H 15/00* (2013.01); *A61H 23/02* (2013.01); *A61H 2015/0014* (2013.01); *A61H 2201/0149* (2013.01); *A61H 2201/1633* (2013.01); *A61H 2201/5043* (2013.01); *A61H 2201/5058* (2013.01); *A61H 2201/5061* (2013.01); *A61H 2201/5084* (2013.01); *A61H 2205/086* (2013.01)

(58) Field of Classification Search
CPC .... A61H 2201/0134; A61H 2201/0149; A61H 2201/1633; A61H 2205/086; A47C 9/002; A47C 7/40

See application file for complete search history.

(56) References Cited

U.S. PATENT DOCUMENTS

| | | | | |
|---|---|---|---|---|
| 2,258,931 | A * | 10/1941 | Heer | A61H 15/0085 601/113 |
| 4,178,921 | A * | 12/1979 | Kosiak | A61H 15/0078 601/112 |
| 4,650,247 | A | 3/1987 | Berg et al. | |
| 5,273,028 | A * | 12/1993 | McLeod | A61F 2/28 601/35 |
| 5,590,930 | A | 1/1997 | Glockl | |
| 5,921,628 | A | 7/1999 | Glockl | |
| 6,053,880 | A | 4/2000 | Sleichter, III | |
| 6,744,370 | B1 * | 6/2004 | Sleichter, III | B60N 2/448 340/575 |
| 7,311,681 | B1 | 12/2007 | Vaccarella | |
| 7,607,738 | B2 | 10/2009 | Gregory et al. | |
| 7,713,220 | B2 | 5/2010 | Chen | |
| 8,372,111 | B2 | 2/2013 | Reyna | |
| 9,315,165 | B2 * | 4/2016 | Hollerer | B60R 16/03 |
| 2005/0242635 | A1 | 11/2005 | Cassady | |
| 2006/0049678 | A1 * | 3/2006 | Kern | A47C 7/467 297/284.3 |
| 2010/0026142 | A1 | 2/2010 | Jones et al. | |
| 2011/0040218 | A1 * | 2/2011 | Ferber | A61H 23/02 601/49 |
| 2011/0095586 | A1 | 4/2011 | Fernandez | |
| 2013/0113249 | A1 | 5/2013 | Cvek | |

* cited by examiner

THERAPEUTIC CORE BUILDING AND MASSAGE CHAIR

CROSS-REFERENCE TO RELATED APPLICATION(S)

This application claims priority to, and the benefit of, U.S. Provisional Application No. 61/986,044, filed Apr. 29, 2014, for all subject matter common to both applications. The disclosure of said provisional application is hereby incorporated by reference in its entirety.

FIELD OF THE INVENTION

The present invention relates to a core dynamic seating chair, suitable for selective massage therapy. In particular, the present invention relates to a chair providing therapeutic massage therapy of gluteal and piriformis muscles of a user through rocking motions implemented by the user.

BACKGROUND

Generally, designed for longer term sitting, chairs can be uncomfortable. Sedentary working environments promote little to no engagement of core muscles while sitting and can result in debilitating health problems. Engaging the core muscles while sitting can improve core strength and posture, and targeting key muscle groups such as the gluteal and piriformis muscles further enhance comfort, especially around the sciatic nerve.

Both U.S. Pat. Nos. 5,590,930 and 5,921,628 portray active seats that utilize a mechanism in the base promoting the use of core muscles while sitting. This mechanism allows for tilting in all directions about an axis, and also includes a mechanism which returns the seat to its original position. However, the devices described in these patents do not provide sufficient adjustments to better suit different body types.

Beyond activating core muscles, targeting key muscle groups are an important method of promoting circulation. U.S. Pat. No. 8,372,111 describes methods in which to activate the piriformis muscle through active and passive massaging. However, there is no suggestion or teaching as to integration of a mechanism into a seat having similar functionality, nor is there any discussion as to how any such functionality would be achieved by user operation.

U.S. Patent Application Publication 2011/0095586 describes a tilting mechanism that allows for full rotation about a single axis, along with tilting in all directions. There exists a need to fix the rotational axis of the chair to be able to stretch and engage back muscles while in the seated position, and with no way of fixing the rotational axis, the device of this publication is limited only to activating muscles in a user's core.

U.S. Patent Application Publication 2013/0113249 combines a chair with electronic sensors, data transfer capabilities, and a power source, but only uses these capabilities to suggest proper use of the seat.

SUMMARY

There is a need for a tilting chair that includes massaging elements to activate the gluteal and piriformis muscle groups to reduce pressure on the sciatic nerve, a method to promote mobility of the chair, a method for stretching the back muscles, and electronic data collection for tracking muscular improvement, and ultimately, promoting better seating habits. Likewise, there is a need for a chair capable of generating, through interaction with a user, sufficient energy to power certain features of the chair. The present invention is directed toward further solutions to address these needs, in addition to having other desirable characteristics. Specifically, an improved adjustable tilting chair provided herein includes integrated massagers built into the chair. Improved mobility from locking castors allows for relocation of the chair around a busy space, and an integrated back support further adds to the overall function of the chair. Passive or active massaging components promote circulation around the gluteal and piriformis muscle groups, and the angle of side-to-side tilt of the chair is proportional to the resultant pressure applied to the gluteal and piriformis muscle groups through these integrated massagers built into the chair. Power can be generated through the side-to-side movement of the chair and is combined with a power storage device, which allows integrated sensors to measure, display, and transmit data to a device which then allows the user to understand metrics such as improvement in overall health.

In accordance with an embodiment of the present invention, a chair includes a seat profile structure disposed atop a base, the seat profile structure having a surface formed of a combination of convex and/or concave surface features providing structural side to side support of a user sitting thereon. A left side piriformis muscle massage mechanism is incorporated into the seat profile structure in a position underneath a left side piriformis muscle of a user sitting thereon. A right side piriformis muscle massage mechanism is incorporated into the seat profile structure in a position underneath a right side piriformis muscle of a user sitting thereon. The left side piriformis muscle massage mechanism and the right side piriformis muscle massage mechanism apply massage action against the left piriformis muscle and the right piriformis muscle of a user upon the user rocking across the seat profile structure.

In accordance with aspects of the present invention, wherein the left side piriformis muscle massage mechanism and the right side left side piriformis muscle massage mechanism each include a plurality of rollers having central axes of rotation along a generally radial path from a center of the seat profile structure. The plurality of rollers rotate freely, or the plurality of rollers incorporate a resistance force against free rotation.

In accordance with aspects of the present invention, the left side piriformis muscle massage mechanism and the right side piriformis muscle massage mechanism each include a rotating mechanism each having an axis of rotation generally orthogonal to the seat profile structure surface.

In accordance with aspects of the present invention, wherein the left side piriformis muscle massage mechanism and the right side piriformis muscle massage mechanism each include vibrating seat mechanism. The vibrating seat mechanism can include an electric motor coupled with a power source. The vibrating seat mechanism can be coupled with a timer or clock mechanism with an alarm activating vibration of the vibrating seat mechanism at desired times.

In accordance with aspects of the present invention, a piezo electric energy harvester can be coupled with the chair in such a way that energy is generated from mechanical movement of the seat profile structure by the user sitting thereon. The chair can further include an energy storage device coupled with the piezo electric energy harvester in such a way that electrical power generated by the piezo electric energy harvester is stored in the energy storage device. The energy storage device can be a battery, a capacitor, or a mechanical system which stores potential energy. The chair can further include a data recordation and transmission mechanism, configured to record and transmit data to users corresponding to chair usage.

In accordance with aspects of the present invention, the chair further includes a chair back coupled with the chair. The chair back can be sized, shaped, and dimensioned in such a way to enable shoulder blades of a user to grip the chair back therebetween while the user performs a back stretch.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1:
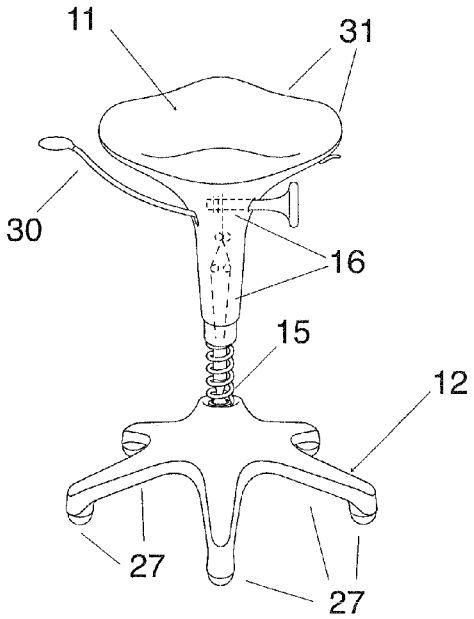
FIG. 1 is a perspective front view of a chair constructed in accordance with the present invention.

An illustrative embodiment of the present invention relates to a chair providing therapeutic massage therapy of gluteal and piriformis muscles of a user through rocking motions, according to the present invention. Piriformis muscle massage mechanisms are specifically sized, dimensioned, and positioned in the seating surface of the chair to engage with pressure points underneath the gluteal and piriformis muscles of a user sitting on the chair in a normal, conventional, chair use. Depending on configuration, mechanical energy harvesting devices can be coupled with the chair to capture movement of the user and transform it into electric power for storage and use by, for example, a measurement device, data acquisition and transmission unit, which records and transmits data about chair usage to the user.

FIGS. 1 through 10A, wherein like parts are designated by like reference numerals throughout, illustrate an example embodiment or embodiments of a chair providing therapeutic massage therapy of gluteal and piriformis muscles of a user through rocking motions, according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

FIG. 1 is a perspective view taken from the front of a chair 11 constructed in accordance with one embodiment of the invention. A lower base 12 is constructed of legs protruding radially from a center and containing lockable castors 27, which rotate freely until weight is applied to the chair 11 and locks them in place. The chair 11 is supported by a flex mechanism 15, in which tension can be adjusted by tightening a tunable tilting mechanism 16. The flex mechanism 15 refers to any device which deforms elastically without yielding and enables a side-to-side rocking movement from the user, as would be appreciated by those of skill in the art. The flex mechanism 15 is tunable to adjust the resistance of the flex mechanism 15 when the user leans side-to-side.

A lever 30 extends from a location along the chair 11 and activates a mechanism to raise or lower the overall height of the base 12 relative to the ground surface, as is well known by those of skill in the art. A seat profile structure 31 is shaped such that the seat profile structure 31 cups the user while sitting on the seat profile structure. This seat profile structure 31 shape can take the form of a concave and/or convex profile, providing one or more pockets which help the user stay in place on the seat profile structure 31. For example, this seat profile structure 31 may take the form of a saddle-like shape or an inverted dome. This seat profile structure 31 is useful in that it provides additional support and stability for the user while performing seated back stretches.

Figure 1A:
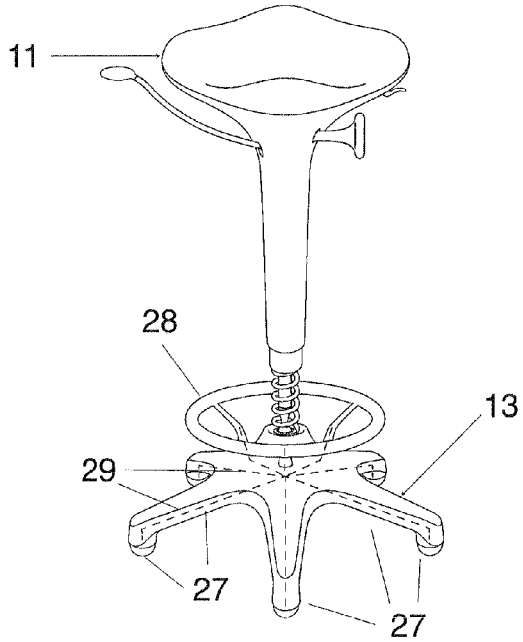
FIG. 1A is a perspective front view of the chair of FIG. 1 depicted with a taller height.

FIG. 1A is a perspective view taken from the front of the chair 11 constructed in accordance with one embodiment of the present invention. In this embodiment, base 13 is designed for a taller overall seat height. Applications for this embodiment include but are not limited to bar height seating, lab bench environments, or research facilities with standing height tables. A locking foot lever 28 is in place to provide additional support while seated, and when activated, the lever 30 provides additional locking force to castors 27 through a locking foot lever mechanism 29. This locking force may be translated through the castors 27 in the form of cables, or alternative satisfactory mechanical means may include activating high friction materials, or using spring assisted clamps, to lock the castors 27, as would be readily appreciated by those of skill in the art.

Figure 2:
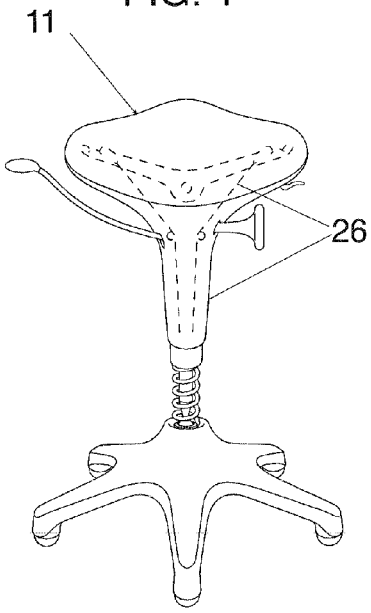
FIG. 2 is a perspective front view of the chair of FIG. 1, showing a piriformis pressure linkage mechanism in an upright position.

FIG. 2 is a perspective view taken from the front of the chair 11, constructed in accordance with an example embodiment of the present invention. A piriformis linkage mechanism 26 is shown in the non-activated position. When the seat profile structure 31 is rocked side-to-side by the user sitting in the chair 11, the piriformis linkage mechanism 26 applies pressure to the seat profile structure 31 of the chair 11 in that respective direction. This piriformis linkage mechanism 26 can take the form of a cable assembly, but additional embodiments may include specially shaped cams and levers that convert small side to side movements to usable massaging movement, or a geared mechanism which uses mechanical advantage to optimize massaging capabilities, as would be appreciated by those of skill in the art.

Figure 2A:
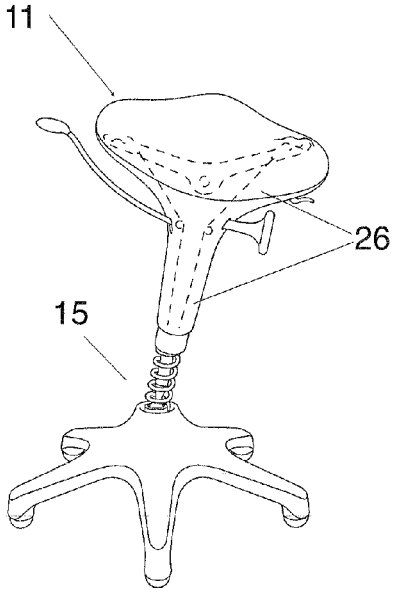
FIG. 2A is a perspective front view of the chair of FIGS. 1 and 2, showing a piriformis linkage pressure mechanism in a leaning orientation.

FIG. 2A is a perspective view taken from the front of chair 11 constructed in accordance with an example embodiment of the present invention. A piriformis linkage mechanism 26 is shown in one of many possible activated positions. As shown, the chair 11 in its rocked position applies additional pressure to the seat profile structure 31 in the direction leaned.

Figure 3:
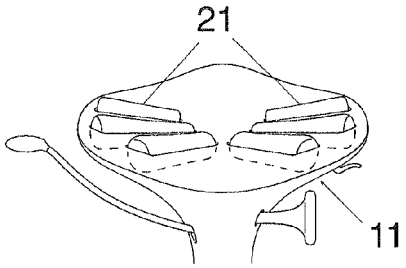
FIG. 3 is a perspective front view of the chair of FIGS. 1 and 2 with an integrated seat roller assembly depicted.

FIG. 3 is a close-up partial perspective view of the front of chair 11 constructed in accordance with one example embodiment of seat rollers 21. The seat rollers 21 are integrated into the seat profile structure 31, and positioned specifically to activate blood circulation about the piriformis muscle of the user. This mitigates pain in the sciatic nerve associated with long periods of sitting. These seat rollers 21 may roll freely, or may provide resistance to further engage the gluteal and piriformis muscle groups. The seat rollers 21 are positioned in such a way that each of their central axes of rotation lie along a generally radial path from an approximate center area of the seat profile structure, as depicted in FIG. 3.

Figure 3A:
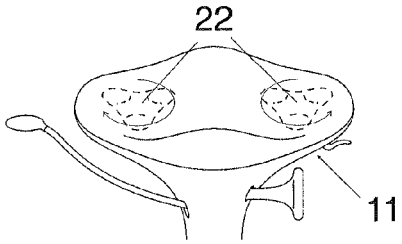
FIG. 3A is a perspective front view of the chair of FIG. 3, with a rotating seat massager mechanism depicted.

FIG. 3A is a close-up partial perspective view taken from the front of the chair 11 constructed in accordance with one example embodiment of a rotating seat mechanism 22. The rotating seat mechanism 22 is integrated into the seat profile structure 31, and rocking by the user sitting on the rotating seat mechanism 22 activates blood circulation about the piriformis muscle in a similar fashion to the seat rollers 21. This action mitigates pain in the sciatic nerve associated with long periods of sitting. The rotating seat mechanism 22 may be activated when the user rocks side to side, or through a powered motor. The rotating seat mechanism has an axis of rotation generally orthogonal to the seat profile structure 31 surface, as depicted in FIG. 3A.

Figure 3B:
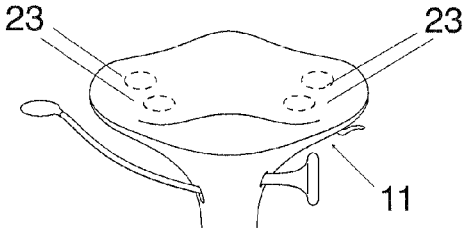
FIG. 3B is a perspective front view of the chair of FIG. 3, with vibrating devices depicted.

FIG. 3B is a close-up partial perspective view taken from the front of chair 11 constructed in accordance with one example embodiment of a vibrating seat mechanism 23. The vibrating seat mechanism 23 is integrated into the seat profile structure 31, and with powered vibration, activates blood circulation about the piriformis muscle of a user. The vibrating seat mechanism 23 vibrates at a regular frequency, and can be provided by a vibrating motor, as would be appreciated by those of skill in the art. These embedded vibrating seat mechanisms 23 may additionally be used as a wake function (if in communication with a clock mechanism) to remind the user of certain recurring exercises, or suggest improvements as detected by built-in sensors. This mitigates pain in the sciatic nerve associated with long periods of sitting, and can improve adherence through increased motivation by reminding the user when to perform exercises.

In accordance with the example illustrative embodiments of FIGS. 3, 3A, and 3B, the chair 11 can be constructed to dimensionally accommodate an average user, or customized to dimensionally accommodate a non-average user. For example, for an average user, the location of the piriformis muscle massage mechanism (i.e., seat rollers 21, rotating seat mechanism 22, and vibrating seat mechanism 23) is on the left and right sides of the seat profile structure 31, and centered approximately 6 inches from the back edge of the seat profile structure 31 (i.e., on the chair back 14 side of the seat profile structure 31). When targeting the piriformis muscles, the seat profile structure 31 is preferably a generally saddle shape to provide front to back and side to side stabilization of the user as they implement a rocking motion across the seat rollers 21, rotating seat mechanism 22, or vibrating seat mechanism 23, to receive therapeutic massage therapy of the piriformis muscles along mechanically engaged pressure points. The generally saddle shape of the seat profile structure 31 provides side to side stabilization, but allows for front to back movement in the specific instance of use with the seat rollers 21, which are best utilized by allowing the user to slide forward and backward across the seat rollers 21 at the mechanical pressure points of the piriformis muscles, thereby receiving therapeutic massage therapy.

Figure 4:
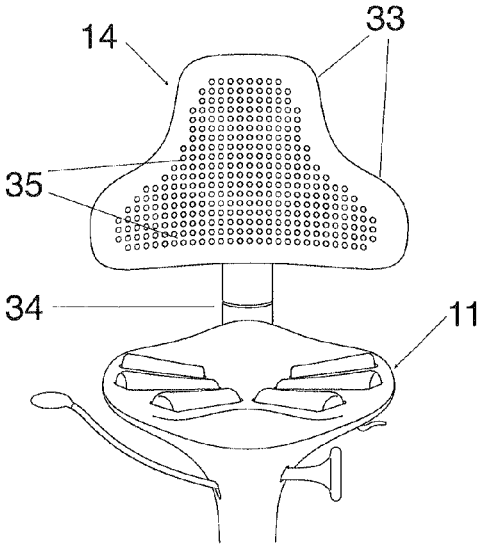
FIG. 4 is an embodiment of the chair of FIGS. 1, 2, and 3, with a chair back attached.

FIG. 4 is a close-up partial perspective view taken from the front of the chair 11 constructed in accordance with one example embodiment of the present invention, which includes chair back 14. The chair back 14 has a specialized chair back profile 33 that is shaped in such a way to enable shoulder blades of a user to grip the chair back 14 when stretching the back about a chair back linkage 34, as depicted in FIG. 4. This chair back 14 has a curved profile, and includes cut-outs to allow the shoulder blades to fit comfortably around the chair back 14. Passive cooling holes 35 are incorporated to promote air flow about the chair back.

Figure 4A:
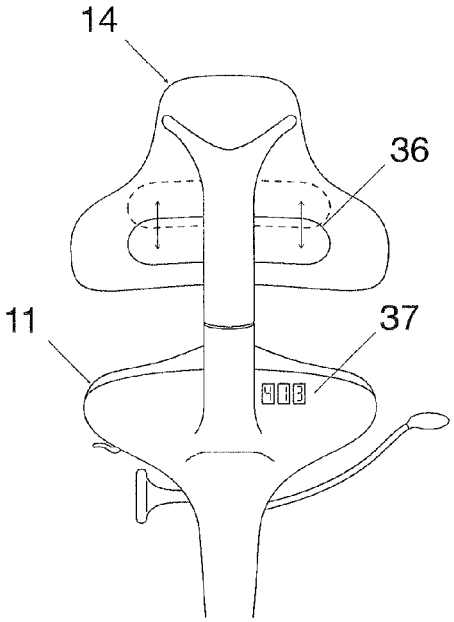
FIG. 4A is a rear view of the chair of FIG. 4, with the chair back attached.

FIG. 4A is a close-up partial view taken from the back of the chair 11 constructed in accordance with one example embodiment of the present invention, which includes the chair back 14. Positioned on the back of a chair 11, the chair back 14 is a mechanism which provides adjustable lumbar support 36, and located on the base of the chair 11 is a chair position and a settings indicator 37 which displays the position of numerous adjustable settings of the chair at any given time. The lumbar support could take the form of adjustable rails which allow the user to tailor support for their body, and the indicator could take the form of a mechanically activated or digital display.

Figure 4B:
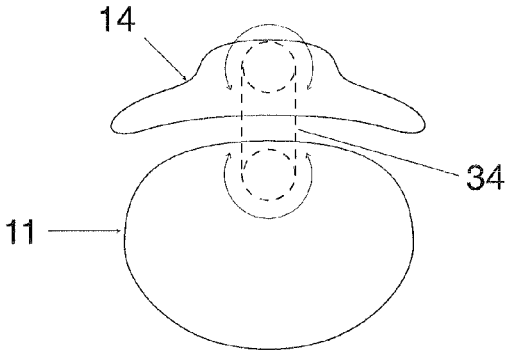
FIG. 4B is a top view of the chair of FIGS. 4 and 4A, showing a chair back mechanism.

FIG. 4B is a top view of the chair 11 constructed in accordance with one example embodiment of the present invention, which includes the chair back 14. A chair back linkage 34 includes an arm and two rotational pivot points to allow for conformity of the chair back 11 when engaging in stretching exercises. The purpose of including two pivot points is to ensure that the user's back is constantly fully engaged with the chair back 14, even while engaging in seated back exercises. The chair back has a home position of neutral, and will always bias towards that home position through the use of springs or some other resilient material. The flexible aspect of this mechanism could come from a metal coil or a deliberately flexible plastic designed to deform elastically without yielding.

Figure 5:
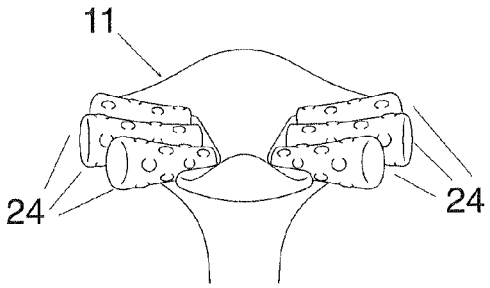
FIG. 5 is an embodiment of the seat of FIG. 3, with individual seat rollers.

FIG. 5 is a close-up partial perspective view taken from the front of the chair 11. This example embodiment demonstrates an alternative seating configuration which incorporates individual seat rollers 24. The seat rollers 24 may be easily interchanged or adjusted to provide a custom fit for any user. These may be mounted using a post which runs concentric through the seat roller 24, and tightening the post influences the shape and profile of the seat roller 24 (e.g., shortening the post causes the roller to increase its diameter, whereas lengthening the post causes the roller to decrease its diameter, as would be readily understood by those of skill in the art). Changes to the seat roller 24 when tightened include but are not limited to changes in diameter, length, profile, stiffness, and resistance to rolling, as can be readily understood by those of skill in the art, such that additional description is not required.

Figure 5A:
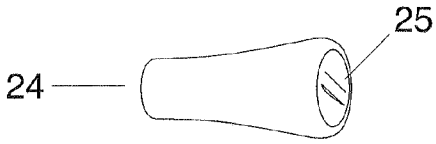
FIG. 5A is a close-up perspective view of an individual seat roller as depicted in FIG. 5.

FIG. 5A is a close-up partial perspective view of an individual seat roller 24. Built into the individual seat roller 24 is a profile adjustment mechanism 25, which, when tightened, compresses an internal mechanism inside the individual seat roller 24, resulting in a new shape. This resultant shape may be controlled by incorporating numerous materials and embedding inserts of various rigidities into an individual seat roller 24, as would be readily appreciated by those of skill in the art.

Figure 5B:
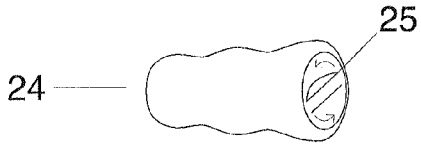
FIG. 5B is a close-up perspective view of an individual seat roller as depicted in FIG. 5, with its internal mechanism in a compressed state.

FIG. 5B is a close-up partial perspective view of the individual seat roller 24 with an internal mechanism having been compressed by the profile adjustment mechanism 25. As noted in the figure, this particular instance reflects an individual seat roller 24 with numerous inserts of different rigidity, resulting in an undulating profile. Other materials and combinations may respond differently, generating additional profiles such as concave or convex shapes. Changes to the roller when tightened include but are not limited to changes in diameter, length, profile, stiffness, and resistance to rolling, as would be readily appreciated by those of skill in the art.

Figure 6:
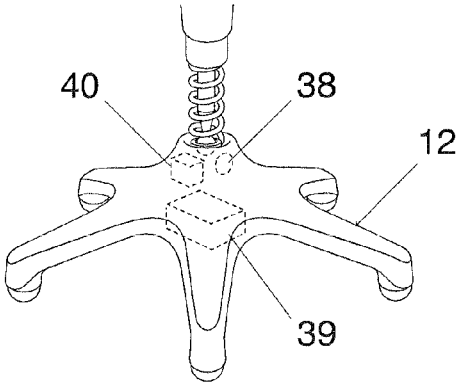
FIG. 6 is a close-up perspective front view of a base of the chair depicted in FIGS. 1 and 2.

FIG. 6 is a close-up partial perspective view taken from the front of base 12 constructed in accordance with one example embodiment of the present invention. Piezo electric energy harvesters 38 coupled with the chair 11 generate energy from constant or repeated movement of the tension post to which they are mounted. Energy storage 39 captures piezo electric energy 38 and energy from any other sources, and powers a measurement device, data acquisition and transmission unit 40. The energy storage 39 can take the form of batteries, capacitors, or a mechanical system which stores potential energy. The measurement device, data acquisition and transmission unit 40 can capture information such as weight of the user, movement, and number of times seated. The measurement device, data acquisition and transmission unit 40 can be composed of micro-electromechanical components, such as accelerometers and gyroscopes, position encoders, hall effect and capacitance sensors, and strain gauges. The data acquisition unit portion can convert this information to visual data, which may then be transmitted to a work station, mobile device, or network for further analysis by the user. By data acquisition unit, what is meant is any internal or external device, which has the ability to communicate with the measurement devices. This visual data can take the form of interactive graphs and charts to, e.g., help the user better understand their seating habits.

Figure 7:
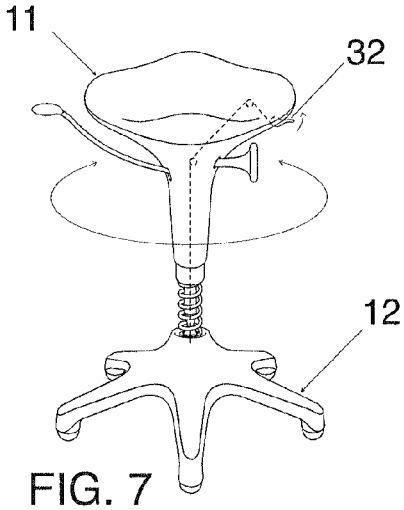
FIG. 7 is an embodiment of the chair of FIGS. 1 and 2, demonstrating the rotational movement of the seat base.

FIG. 7 is a close-up partial perspective view taken from the front of the chair 11. A rotating lock 32 can be activated to allow for circular rotation of the seat about the central axis. The rotating lock 32 defaults in the locked position, meaning that unless activated, the user is not be able to rotate the seat about its concentric axis.

Figure 8:
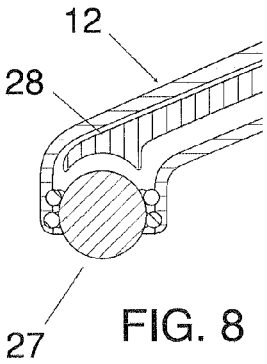
FIG. 8 is a cross sectional view of the seat base and castor of FIG. 1 in an unlocked state.

FIG. 8 is a close-up partial cross-sectional view of the base 12. This figure depicts the unactivated mode of one example embodiment of locking a castor 27 in place with a castor locking mechanism 28.

Figure 8A:
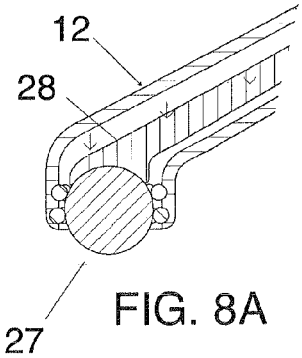
FIG. 8A is a cross sectional view of the seat base and castor of FIG. 8 in an locked state.

FIG. 8A is a close-up partial cross sectional view of the base 12. This figure depicts the activated mode of one embodiment of locking the castor 27 in place with the castor locking mechanism 28 activated. When activated, friction between the castor 27 and the castor locking mechanism 28 prevents the castor 27 from rotating. In all embodiments of locking castors 27, the chair retains its mobility when not in use.

When weight is applied to the chair, which is indicative of the chair being used, the chair is no longer able to move. This allows for the chair 11 to be easily moved out of the way when not in use, yet remain in place when a seated user engages in stretching exercises.

Figure 9:
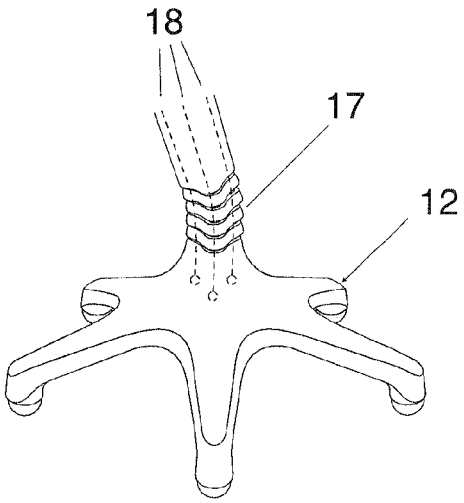
FIG. 9 is an embodiment of a spine flex mechanism in its bent position while mounted to the base of the chair depicted in FIGS. 1 and 1A.

FIG. 9 is a close-up perspective view taken from the front of base 12 constructed in accordance with one example embodiment of the present invention, depicted here in the tilted position. A spine flex mechanism 17 can be adjusted by tightening the tunable resistance mechanism 18. The spine flex mechanism 17 generally refers to any stackable set of components that work together to allow for side-to-side movement as would be appreciated by those of skill in the art. An individual spine piece may be composed of a solid core surrounded by a more compliant material to allow for this movement. Compressing an assembly of these individual 'spines' with a tunable resistance mechanism offers a more natural movement than other known mechanisms, as would be readily appreciated by those of skill in the art.

Figure 9A:
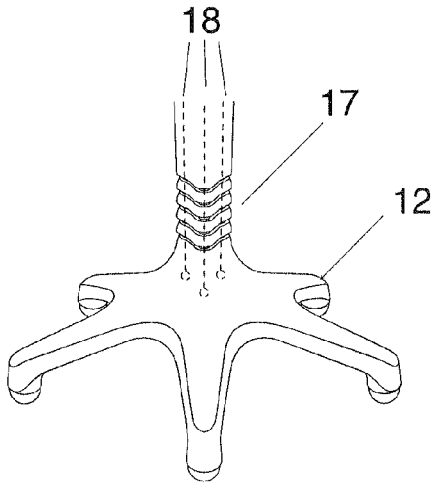
FIG. 9A is an embodiment of a spine flex mechanism in its default position mounted to the base of the chair depicted in FIGS. 1 and 1A.

FIG. 9A is a close-up partial perspective view taken from the front of base 12 constructed in accordance with one example embodiment of the present invention, depicted here in the default position. The spine flex mechanism 17 can be adjusted by tightening the tunable resistance mechanism 18. The material properties of a tunable resistance mechanism 18 may be dialed in to further influence the flexibility of a spine flex mechanism 17, as would be understood by those of skill in the art.

Figure 10:
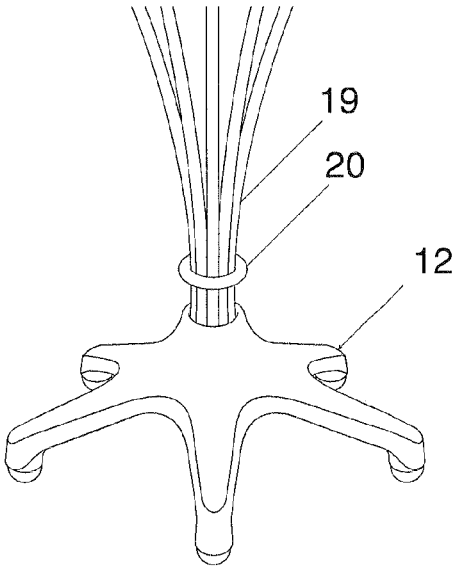
FIG. 10 is an embodiment of an organic reed flex mechanism in a default position mounted to the base of the chair depicted in FIGS. 1 and 1A.

FIG. 10 is a close-up partial perspective view taken from the front of the base 12 constructed in accordance with one example embodiment of the present invention, depicted here in the default position. An organic reed flex mechanism 19 can be adjusted by raising or lowering a tunable resistance mechanism 20. The organic reed flex mechanism 19 generally refers to a bundle of semi-flexible rods, which when used together, flex and comply accordingly in a side-to-side motion if the user shifts their weight side-to-side. If designed with material properties in mind, this single embodiment may be used as the seat profile structure 31.

Figure 10A:
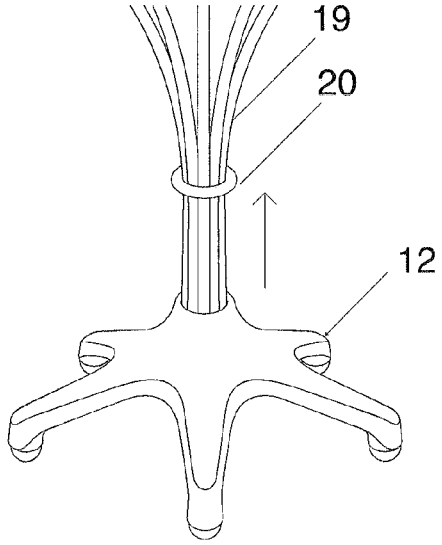
FIG. 10A is an embodiment of an organic reed flex mechanism in a bent position mounted to the base of the chair depicted in FIGS. 1 and 1A.

FIG. 10A is a close-up partial perspective view taken from the front of the base 12 constructed in accordance with one example embodiment of the present invention, depicted here in an adjusted position. The organic reed flex mechanism 19 can be adjusted by raising or lowering the tunable resistance mechanism 20. When the tunable resistance mechanism 20 is extended up and down, the length of material which is free to flex changes, thus influencing the overall stiffness of the system, allowing for users of different weights to customize their chair, as would be readily understood by those of ordinary skill in the art.

As utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about" and "approximately" are intended to cover variations that may existing in the upper and lower limits of the ranges of subjective or objective values, such as variations in properties, parameters, sizes, and dimensions. In one non-limiting example, the terms "about" and "approximately" mean at, or plus 10 percent or less, or minus 10 percent or less. In one non-limiting example, the terms "about" and "approximately" mean sufficiently close to be deemed by one of skill in the art in the relevant field to be included. As utilized herein, the term "substantially" refers to the complete or nearly complete extend or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A chair, comprising:

a seat profile structure disposed atop a base, the seat profile structure having a surface formed of a combination of convex and/or concave surface features providing structural side to side support of a user sitting thereon;

a left side piriformis muscle massage mechanism incorporated into the seat profile structure in a position adapted to be underneath a left side piriformis muscle of a user sitting thereon;

a right side piriformis muscle massage mechanism incorporated into the seat profile structure in a position adapted to be underneath a right side piriformis muscle of a user sitting thereon;

wherein the left side piriformis muscle massage mechanism and the right side piriformis muscle massage mechanism are adapted to apply massage action against the left piriformis muscle and the right piriformis muscle of a user upon the user rocking across the seat profile structure;

wherein the left side piriformis muscle massage mechanism and the right side left side piriformis muscle massage mechanism each comprise a plurality of rollers having central axes of rotation along a generally radial path from a center of the seat profile structure.

2. The chair of claim 1, wherein the plurality of rollers rotate freely.

3. The chair of claim 1, wherein the plurality of rollers incorporate a resistance force against free rotation.

4. The chair of claim 1, further comprising a piezo electric energy harvester coupled with the chair in such a way that energy is generated from mechanical movement of the seat profile structure by the user sitting thereon.

5. The chair of claim 4, further comprising an energy storage device coupled with the piezo electric energy harvester in such a way that electrical power generated by the piezo electric energy harvester is stored in the energy storage device.

6. The chair of claim 5, wherein the energy storage device comprises, a battery, a capacitor, or a mechanical system which stores potential energy.

7. The chair of claim 1, further comprising a data recordation and transmission mechanism, configured to record and transmit data to users corresponding to chair usage.

8. The chair of claim 1, further comprising a chair back coupled with the chair.

9. The chair of claim 8, wherein the chair back is sized, shaped, and dimensioned in such a way to enable shoulder blades of a user to grip the chair back therebetween while the user performs a back stretch.

* * * * *